United States Patent [19]

Carpenter et al.

[11] 4,247,854

[45] Jan. 27, 1981

[54] GAS PANEL WITH IMPROVED CIRCUIT FOR DISPLAY OPERATION

[75] Inventors: Kim H. Carpenter; Robert R. O'Dell, both of Cambridge, Ohio

[73] Assignee: NCR Corporation, Dayton, Ohio

[21] Appl. No.: 37,546

[22] Filed: May 9, 1979

[51] Int. Cl.[3] ..... H05B 37/00

[52] U.S. Cl. ..... 340/758; 315/169.4; 340/776; 340/779

[58] Field of Search ..... 340/758, 776, 779; 315/169.4

[56] References Cited

U.S. PATENT DOCUMENTS

| | | | |
|---|---|---|---|
| 3,786,485 | 1/1974 | Wojcik | 340/779 X |
| 3,793,628 | 2/1974 | Gaur | 340/799 X |
| 3,851,210 | 11/1974 | Schermerhorn | 340/779 |
| 3,894,263 | 7/1975 | Wojcik | 315/169.4 |
| 3,894,506 | 7/1975 | Mayer et al. | 340/776 |
| 4,099,097 | 7/1978 | Schermerhorn et al. | 315/169.4 |
| 4,139,803 | 2/1979 | Kurahashi et al. | 340/758 X |

*Primary Examiner*—David L. Trafton
*Attorney, Agent, or Firm*—J. T. Cavender; Wilbert Hawk, Jr.; Richard W. Lavin

[57] ABSTRACT

A driving circuit arrangement for a gas-discharge display device operated asynchronously by a blanking signal generated in a processor applies a voltage level to each of the cells of the display device which is below the voltage level required to fire the cells upon the generation of the blanking signal. This arrangement enables the selected cells to fire upon the subsequent removal of the blanking signal. Switching members are operated by the generation of the blanking signal to precharge each of the cells in the display device during the blanking interval in which data transmitted from the processor selects the character to be displayed.

14 Claims, 12 Drawing Figures

FIG. 1
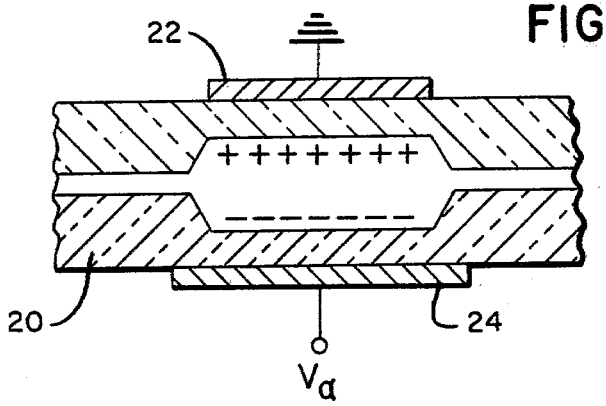
FIG. 2
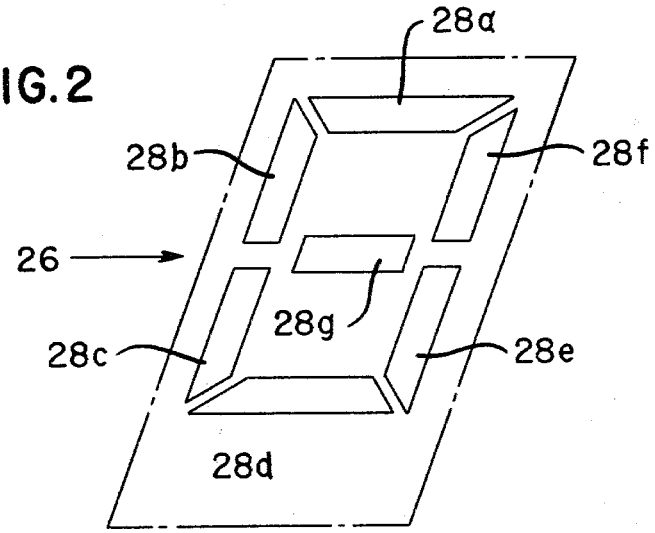
FIG. 7
| | | |
|---|---|---|
| FIG. 6A | FIG. 6B | FIG. 6C |
| FIG. 6D | FIG. 6E | FIG. 6F |

GAS PANEL WITH IMPROVED CIRCUIT FOR DISPLAY OPERATION

BACKGROUND OF THE INVENTION

The present invention is directed to A.C. coupled gas-discharge display devices of the multi-digit or character indicator type and more particularly to a control circuit for driving such a display related to multiplexed operation of such display devices to provide error-free operation of the display device.

It is well-known that an electroluminescent cell can be interposed between first and second electrodes and that, upon the application of a suitable electric potential between the first and second electrodes connected to the cell, the cell will become luminescent because of the ionization which occurs within the cell. This characteristic lends itself quite readily for use in a display panel. A control circuit for driving such a display is shown in U.S. Pat. No. 3,614,769 which issued Oct. 19, 1971, on the application of William E. Coleman et al. and assigned to the assignee of the present invention.

As disclosed in that patent, the application of an electric field to an electroluminescent cell causes ionization to occur within the cell. The electric field imparts energy to electrons which collide with other atoms, thus releasing other electrons. This electron multiplication process continues until breakdown occurs, at which time ignition occurs, that is, a gaseous discharge occurs within the cells, causing positive charges to be deposited on the cell walls connected to the cathode and electrons to be deposited on the cell walls connected to the anode. The charges deposited on the cell walls are trapped because of the capacitive coupling effect exerted by the cell walls. Since positive ions are attached to the cathode wall and electrons are attached to the anode wall, the wall charge will be of a polarity to that of the electric field which instigated the gas discharge. In other words, the voltage contributed by the wall charge will be opposite in polarity to the applied electric field. Thus, it can be seen that, after discharge occurs, the total voltage impressed on the cell will be the algebraic sums of the voltages applied to the cell terminals plus the voltage contributed by the wall charge, which after ignition is negative with respect to the applied voltage, therefore resulting in a decreased cell voltage. The gas discharge which occurs in the cell continues until the wall voltage builds up to a certain value. Its value is given by the relationship $V_a - V_w < V_e$, where $V_a$ is the applied voltage, $V_w$ is the wall voltage, and $V_e$ is the voltage below which the cell is extinguished. In order to energize the cell again using the same magnitude of applied voltage, it is necessary to reverse the polarity of the applied voltage to the cell, thereby impressing an applied voltage across the cell which is adequate with the wall voltage left from the previous discharge, thus permitting a gas discharge to occur in the reverse direction. Since the wall charge is trapped within the cell, the wall voltage will always oppose the voltage which initiated the gas discharge.

Information is visually displayed in the display device in the form of characters, the characters being formed by a group of electroluminescent cells containing an encapsulated gas. The illumination is provided by a gaseous discharge within the cell which occurs upon the application of an electric field at the cell terminals, thereby igniting the cell. Control circuits are provided for selectively energizing the electroluminescent cells, each of which is capacitively coupled between two electrodes, such as a segment electrode and a column electrode. The number of segment electrodes is determined by the number of cells per character, and the number of column electrodes is determined by the number of characters in the display device. Electrically, this takes the form of a matrix in which the columns are called segment electrodes. Each individual cell connected in a column is called a segment cell, and the segment cells in each row are connected to a character or column electrode. One end of each segment electrode and each column electrode is connected to a potential source through appropriate drive transistors. The other ends of the segment and column electrodes are each connected to ground through individual driver transistors. The energization of selected segment cells in addition to a particular column electrode determines the character to be displayed. Circuit means are provided for logically controlling the drive transistors.

In order to illuminate a selected cell for display purposes, it is necessary to alternately energize the electrodes connected to the selected cells. In a multiplexing operation of each character, the cathode electrodes in each of the characters is connected to a common pull-up driver together with a selected number of characters connected to a common column driver. Each segment in the characters is connected to a segment driver. During a multiplexing operation, the display's control logic uses both the common column and segment drivers to designate which cells are to be energized. This process occurs on a scanned, "one column at a time," basis. A blanking period is required between the selection of columns to enable the segment data to be transmitted to the control logic. It was found that due to the multiplexing operation of the existing display systems, certain of the cells were not becoming fully charged prior to their "display-on" operation because of the asynchronous timing between the signals that drive the cells and the signals which determine the cell to be energized. It is therefore the object of this invention to provide a control driver circuit which prevents this misoperation of the cells in the display.

SUMMARY OF THE INVENTION

In order to overcome this problem found in existing multiplexed operated display devices, a control circuit is provided which during the blanking period of a multiplex operation of the display device, each cell in the display device is provided with a voltage level which is below the excitation level of the cell. Upon the subsequent selection of the cell for ionization, a second voltage is applied to the selected cell raising the voltage level applied to the cell above the excitation level of the cell thereby firing the cell.

BRIEF DESCRIPTION OF THE DRAWINGS

FIG. 1 is a sectional view of a gas-discharge cell that can be utilized with the instant invention;

FIG. 2 is a plan view of a representative character display;

FIG. 7 is a diagram showing the manner in which FIGS. 6A–6F inclusive are arranged with respect to each other to form the logic circuits.

DESCRIPTION OF THE PREFERRED EMBODIMENT

FIG. 1 is a representation of an electroluminescent display cell which can be used with the present invention. The cell 20 usually comprises a glass sandwich encapsulating a gas at a particular pressure. A discharge which occurs in the encapsulated gas and provides sufficient illumination for use in visual displays will occur within the cell 20 upon the application of a particular potential $V_a$ between electrodes 22 and 24, the electrodes being located externally of the cell in order to utilize its capacitive properties. The electrons and ions created by the discharge will occur attached to the anode and cathode sides of the glass cell, respectively, to produce what is commonly referred to as a wall charge. The voltage $V_w$ attributed to the wall charge has a polarity opposite to that of the applied voltage $V_a$ which initiated the discharge. Upon reversal of the applied voltage $V_a$, the voltages $V_a$ and $V_w$ will be additive, thereby causing another discharge to occur and permitting the use of a voltage $V_a$ which can be at a lower level than that which originally initiated the discharge.

FIG. 2 shows a plurality of cells of the type illustrated in FIG. 1 combined to form a conventional 7-bar code matrix 26, comprising seven individual segments 28*a–g* inclusive. Individual ones of these segments can be selectively energized to form desired numerical characters. A similar matrix of 14 individual segments are arranged in a manner that is well-known in the art to form characters of the alphacode.

Figure 3:
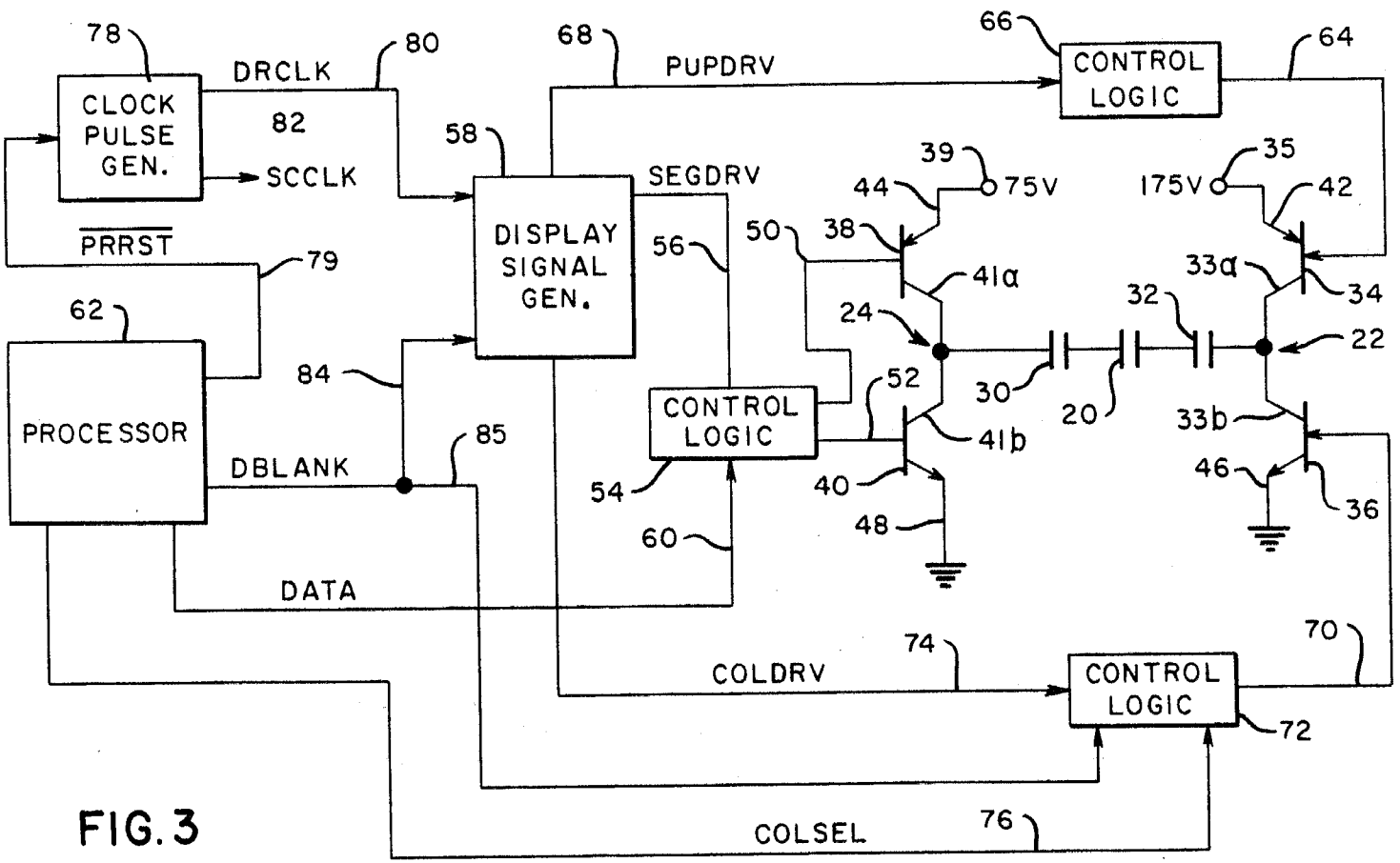
FIG. 3 is a combined block and schematic diagram of the basic driver scheme for energizing a cell comprising the invention.

The electroluminescent cell 20 of FIG. 1 is shown in FIG. 3 as being capacitively coupled to the cell electrodes 22 and 24, in which at least one of the electrodes is transparent for the passage of light. The two coupling capacitances 30 and 32 exist because of the glass dielectric between each exterior electrode and the adjacent interior glass wall surface. Although two coupling capacitors 30 and 32 are shown in FIG. 3, one coupling capacitor could be eliminated, and the combination would still be referred to as the capacitively coupled cell.

The electroluminescent cell electrode 22 (FIG. 3) is shown coupled to the common collectors 33*a* and 33*b* of a PNP transistor 34 and the NPN transistor 36 respectively. The electroluminescent cell electrode 24 is also coupled to the common collectors 41*a* and 41*b* of the PNP transistor 38 and the NPN transistor 40 respectively. The emitter 42 of the transistor 34 is shown connected to a voltage source 35 of 175 volts, while the emitter 44 of the transistor 38 is connected to a voltage source 39 of 75 volts. The emitters 46 and 48 of the transistors 36 and 40 are shown connected to ground. The bases 50 and 52 of the transistors 38 and 40 are shown coupled to a control logic block which, as will be described more fully hereinafter, outputs alternately energizing pulses to the transistors 38 and 40 in which one or the other of the transistors 38 and 40 will always be in a conducting state. The control logic block 54 outputs control pulses to the transistors 38 and 40 under the control of a segment drive signal SEGDRV transmitted over line 56 from a Display Signal Generator 58 together with a 24-bit binary word DATA transmitted over line 60 from a processor 62. The binary bits select which of the cells 20 in the display are to be energized.

The base 64 of the transistor 34 (FIG. 3) is connected to a control logic block 66 which receives a pull-up drive signal PUPDRV transmitted over line 68 from the Display Signal generator 58 while the base 70 of the transistor 36 is connected to a control logic block 72 which receives the column drive signal COLDRV from the Display Signal generator 58 over line 74 and the column select signal COLSEL received from the processor 62 over line 76. As will be explained in more detail hereinafter, the transistors 34 and 40 will be switched into a conducting state by the signals PUPDRV and SEGDRV, thereby impressing the 175 volt power supply across the cell electrodes 22 and 24. The voltage necessary to ignite the cell 20 is greater than the 175 volts applied. The firing voltage which in the present example, is somewhere between 175 volts and 250, is attained when the 175 volts appearing on the emitter 42 of the transistor 34 is combined with the 75 volts appearing on the emitter 44 of the transistor 38. After the voltage appearing at the electrode 22 has risen to a level of 175 volts, the transistors 34 and 40 are switched into a non-conducting state by the drive signals PUPDRV and SEGDRV and the transistors 38 and 36 are driven into a conducting state by the drive signals SEGDRV and COLDRV. This switching action results in the 75 volts being impressed on the electrodes 24 and 22 of the cell 20 by means of a current path which extends from the emitter-collector path of the transistor 38, through the cell 20 and the coupling capacitors 30 and 32, and through the collector-emitter path of the conducting transistor 36 to ground.

The impressing of the 75 volts on the electrode 24 (FIG. 3) combined with the 175 volts which has remained on the electrode 22 due to the capacitive action of the cell 20 in a manner that is well-known in the art will result in the cell 20 reaching a voltage level at which a gaseous discharge occurs. The igniting of the cell 20 and the subsequently discharge causes a wall charge to be deposited on the inside glass surface walls of the cell 20. The wall charge produces a wall voltage opposite in polarity to that of the applied voltage which initially drove the cell into ignition. It will be assumed for purposes of illustration that the wall charge in the illustrated embodiment contributes a voltage of 75 volts. Using this voltage, it can be seen that the cell voltage drops to 75 volts after ignition, since the wall voltage $V_w$ is negative with respect to the applied voltage $V_a$. The transistors 34 and 40 are subsequently switched back into a conductive state again impressing 175 volts at the electrode 22. Upon this occurrence, the voltage across the cell 20 is again sufficiently high to drive the cell into ignition. The above operation is repeated so long as the transistors 34 and 40, together with the transistors 38 and 36 are alternately pulsed into conduction.

Figure 4:
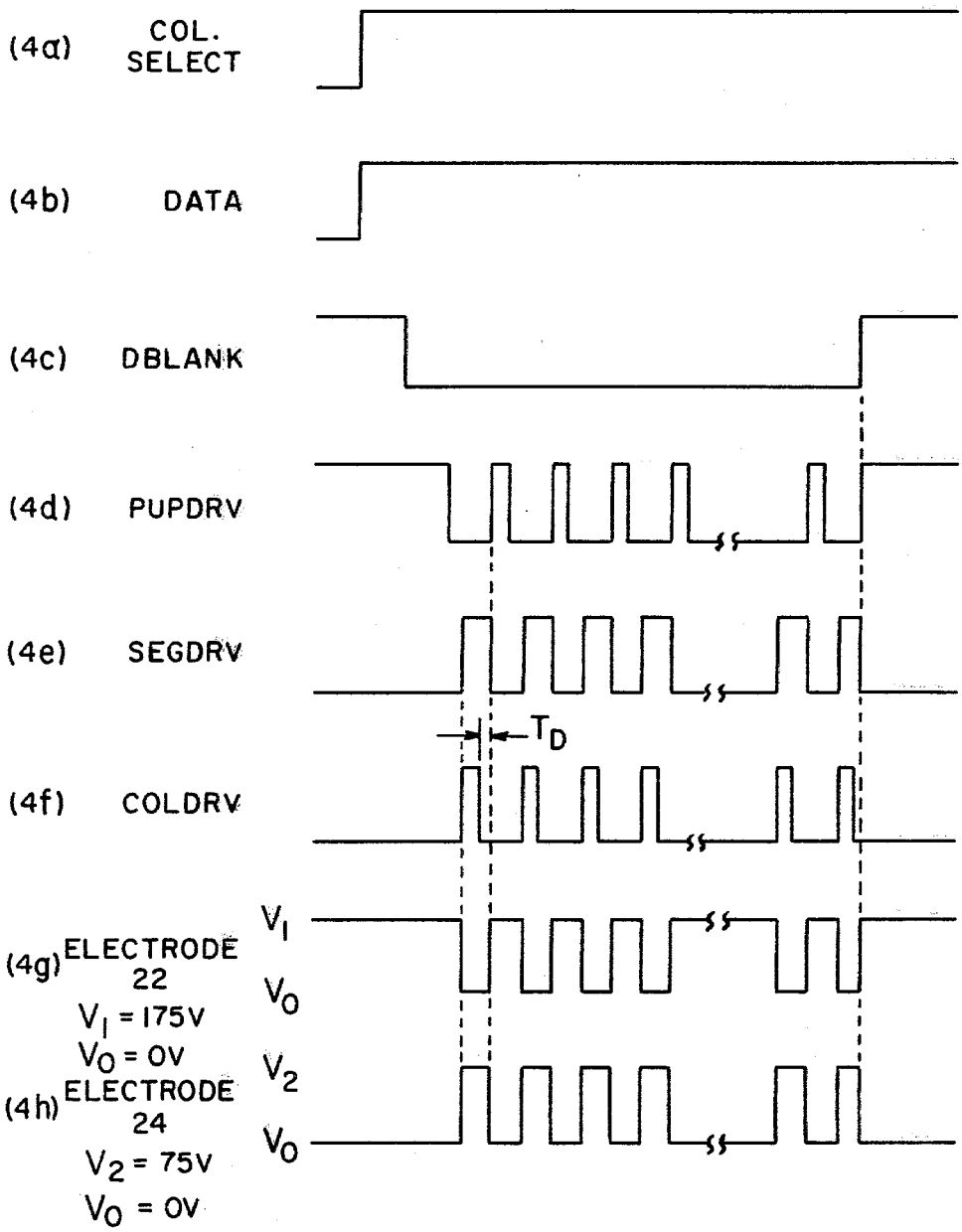
FIG. 4 shows a plurality of waveforms illustrating the operation of the circuit shown in FIG. 3.

Referring now to FIG. 4 there is shown the waveforms of the control pulses which are used to control the operation of the transistors 36–40 inclusive. As shown in FIG. 3, the processor 62 will output the signal $\overline{\text{PRRST}}$ to a clock pulse generator 78 which will output over lines 80 and 82 the clock pulses DRCLK and SCCLK respectively. The drive clock pulse DRCLK is transmitted to the Display Signal generator 58. At this time the signal generator 58 is also receiving a high blanking signal DBLANK (FIG. 4C) from the processor 62. Whenever the display is to be turned on, the blanking signal DBLANK will go low for a period of 1 sec. enabling the Display Signal generator 58 to output the pull-up drive signal PUPDRV over line 68 (FIG. 3) to the control logic block 66 and the segment drive signal SEGDRV over line 56 to the control logic block 54 in a manner that will be described more fully with respect to FIG. 5.

As shown in FIG. 4, the pull-up driver signal PUPDRV being transmitted over line 68 is 180° out of phase with the segment driver signal SEGDRV. When the pull-up driver signal PUPDRV is high, the transistor 34 (FIG. 3) is switched into a conducting state. When the segment driver signal SEGDRV is low, the transistor 38 is switched into a non-conducting state while the transistor 40 is switched into a conducting state, thereby allowing the transistor 34 to transmit the 175 volts through the cell 20 to ground through the transistor 40. When the segment driver signal SEGDRV is high, the transistor 38 is switched into a conducting state and the transistor 40 into a non-conducting state. At the same time that the segment driver signal SEGDRV is high, the column drive signal COLDRV generated over line 74 is also high, thereby switching the transistor 36 into conduction allowing the 75 volts to be impressed upon the cell 20, driving the cell into excitation in the manner described previously. Since both the transistors 34 and 36 cannot be conducting at the same time, otherwise the 175 volts would be transmitted to ground through the transistor 36, the column drive signal COLDRV is returned to zero as shown in FIG. 4F prior to the time the pull-up driver PUPDRV goes high. This time interval is indicated in FIG. 4E as $T_d$. Thus the firing of each of the cells 20, which in the present embodiment corresponds to one of the segments 28*a*–28*g* inclusive (FIG. 2) is dependent on the switching of the transistors 34–40 inclusive in the manner just described during the time the blanking signal DBLANK is low. If prior to the time the cell 20 reaches the voltage level that would fire the cell, the blanking signal DBLANK would be pulled high by the processor 62, the charge remaining on the cell would be at an undefined level which might prevent the cell from reaching the firing level ($V_1+V_2$) during the next selection cycle. The present invention eliminates this problem by applying 175 volts to the cell every time the blanking signal DBLANK goes high.

When the processor 62 pulls up the signal DBLANK (FIG. 4C), the Display Signal generator 58 will raise the pull-up drive signal PUPDRV high and pull down the segment drive signal SEGDRV and the column drive signal COLDRV low. These signals will become static as long as the signal DBLANK remains in a high state. In a manner that will be explained more fully hereinafter, the pull-up drive signal PUPDRV will switch the transistor 34 into a state of conduction. The segment drive signal SEGDRV going low will switch the transistor 40 into a state of conduction allowing the 175 volts to be applied across the cell 20, thereby precharging the cell during the time the signal DBLANK is high. Normally during this time, the processor 62 is outputting a new 24 bit binary word DATA over line 60 through the control logic block 54 designating the next set of cells to be ignited. The column drive signal COLDRV being low at this time will keep the transistor 36 in a non-conducting state, thus insuring that the 175 volts being applied across the transistor 34 cannot be shorted to ground through the conduction of the transistor 36. It will thus be seen from the circuit just described that upon the occurrence of the next "display-on" interval, in which the control signal DBLANK goes low, the pull-up drive signal PUPDRV goes low, returning the transistor 34 to a non-conducting state. At this time the segment drive signal SEGDRV and the column drive signal COLDRV will go high, switching the transistors 36 and 38 into a state of conduction, allowing the 75 volts to be impressed across the cell 20, thereby raising the voltage being impressed across the cell 20 to a level which fires the cell in the manner previously described.

Figure 5:
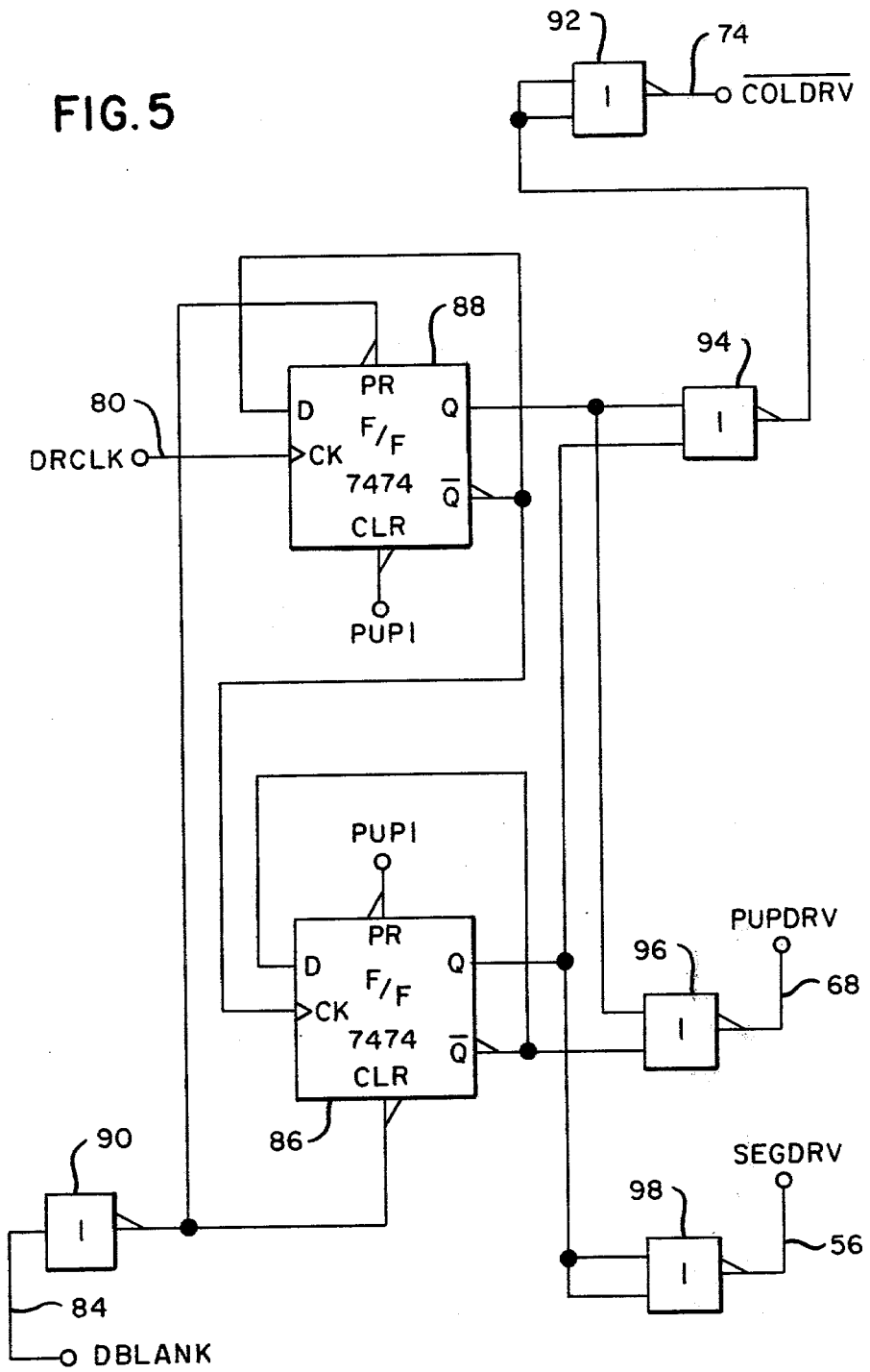
FIG. 5 is a schematic diagram of the display signal generator of FIG. 3.

Referring now to FIG. 5 there is shown a detailed schematic diagram of the Display Signal generator 58 (FIG. 3). The generator comprises a pair of 7474 flip-flops 86 and 88 which are toggled by the clock pulse DRCLK transmitted over line 80 from the clock pulse generator 78 (FIG. 3). The flip-flops 86 and 88 are held in an active state by a high signal appearing on the output of the inverter 90 which receives the blanking signal DBLANK over line 84 from the processor 62 (FIG. 3). As previously described, the processor 62 will raise the signal DBLANK and turn off the cell 20 while 24 bits of new data is transmitted over the line 60 (FIG. 3) to the control logic block 54 for selecting the segments 28 (FIG. 2) which will be illuminated to display the required character. Upon completion of the sending of the data over line 60, the processor 62 will pull down the signal DBLANK (FIG. 4C) resulting in the output signal of the inverter 90 going low, thereby enabling the flip-flops 86 and 88 to output the clock pulses received over line 80 to a plurality of NOR gates 92–98 inclusive. Appearing on the output line 74 of the NOR gate 92 is the column drive signal COLDRV while appearing on the output lines 68 and 56 of the NOR gates 96 and 98 respectively are the pull-up drive signal PUPDRV and the segment drive signal SEGDRV. The signal PUPDRV is transmitted over line 68 to the control logic block 66 (FIG. 3) resulting in transistor 34 in each cell 20 of the display being switched to a conducting state. The segment drive signal, SEGDRV, is transmitted over line 56 (FIG. 3) to the control logic block 54 resulting in the transistors 38 and 40 in the cells 20 selected by the bits in the binary word DATA to be alternately switched between a conducting and non-conducting state, while the column drive signal COLDRV is transmitted over line 74 to the control logic block 72 (FIG. 3) which switches the transistor 36 in the cells 20 of two of the characters in the display to a conducting state. Accordingly, the cells 20 which receive the voltage from the 75 volt and the 175 volt voltage source will be fired due to the switching of the transistors 34–40 inclusive in the manner described previously.

Figure 6A:
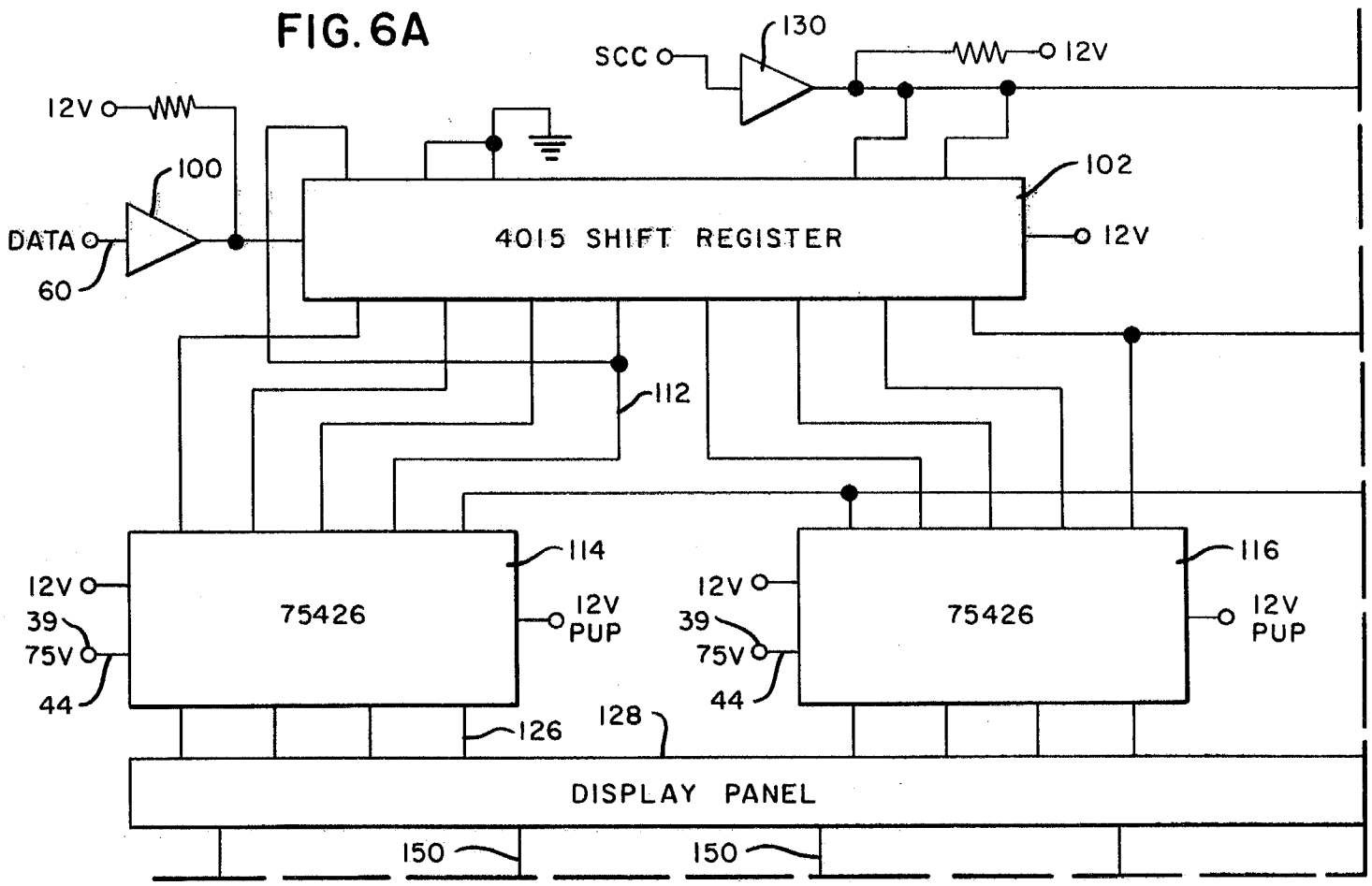
FIGS. 6A–6F inclusive are schematic diagrams of the control logic circuits for the various cell drivers shown in FIG. 3.
Figure 6B:
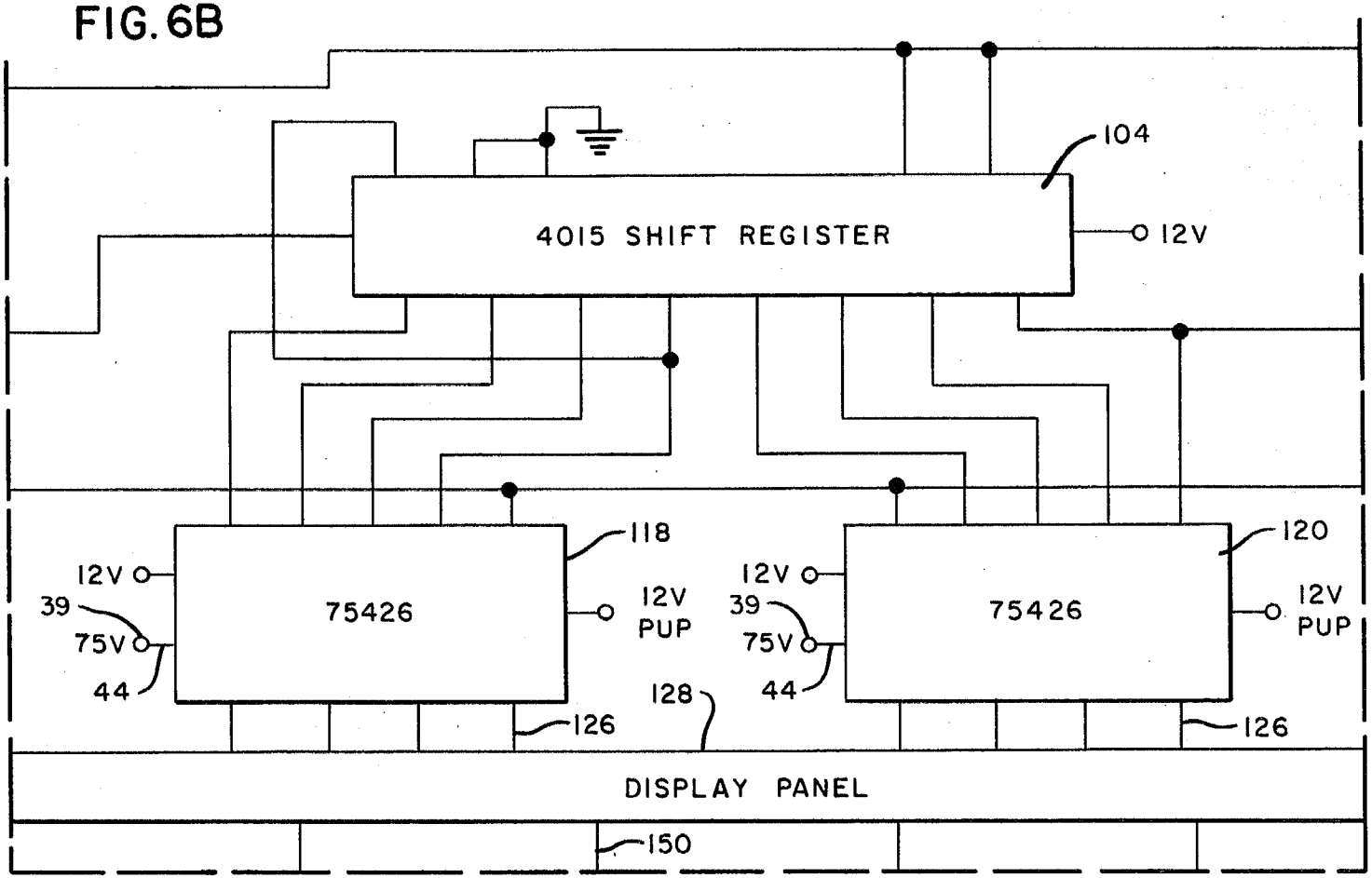
Figure 6C:
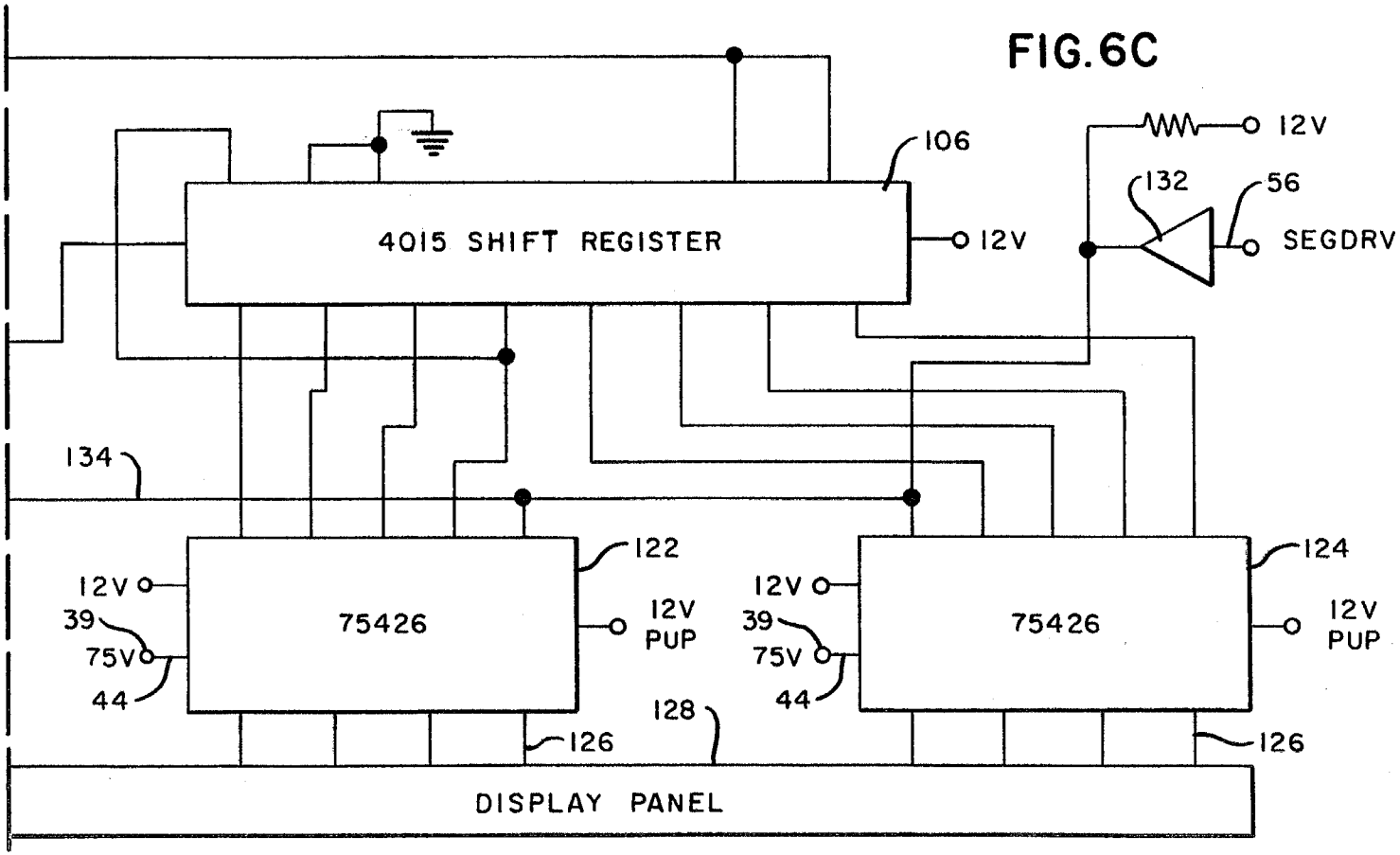

Referring now to FIGS. 6A–6F inclusive arranged in the manner as shown in FIG. 7, there is disclosed the control logic blocks 54, 66 and 72 (FIG. 3) for controlling the driver transistors 34–40 inclusive (FIG.3) to provide the lighting of the characters in the display in accordance with the data transmitted over line 60 (FIG. 3) from the processor 62. Shown in FIGS. 6A–6C inclusive is the control logic block 54 (FIG. 3) which receives over line 56 (FIG. 6C) a segment drive signal SEGDRV and over line 60 24 binary bits of data from the processor which selects seven segments to display a numerical character and fourteen segments to display an alphanumeric character. In addition, three bits of the data word will select segments representing two descriptors and one period. The 24 bits of data are transmitted through a driver 100 and into three 8-bit 4015 shift registers 102–106 inclusive. Each binary bit is transmitted over an output line 112 to one of six 75426 multi-transistor network 114–124 inclusive, each of which comprises the transistors 38 and 40 (FIG. 3) associated with a cell 20 comprising one of the segments 28*a–g* (FIG. 2) of a character. Each of the 75426 multi-transistor networks 114–124 inclusive have output lines 126 each of which is connected to the same segment in each of the characters located in the display panel 128 (FIGS. 6A–6C inclusive).

The display panel 128 contains sixteen characters of which eight comprise the seven segment numerical character of FIG. 2 and eight alphanumeric characters which comprise fourteen segments. Also included in the display panel 128 are three segments representing a period and two descriptors. During the time that the signal DBLANK (FIG. 4C) is high, the processor 62 will transmit 24 bits of data over line 60 into the shift registers 102–106 inclusive for storage therein. The occurrence of the clock signal SCC generated within the logic (not shown) and transmitted through the driver 130 (FIG. 6A), clock the data into the shift registers 102–106 inclusive. As previously described, the segment driver signal SEGDRV (FIG. 4E) is pulsed high when the signal DBLANK goes low initiating a "display-on" interval, which signal is transmitted through the driver 132 (FIG. 6C) and over line 134 to the multi-transistor network 114–124 resulting in the switching of the selected transistors 38 and 40 (FIG. 3) to a conducting state. As previously described, the switching of the transistors 38 and 40 in conjunction with the switching of transistors 34 and 36 results in the 75 volt power supply 39 being transmitted over one of the output lines 126 of the multi-transistor network to a common segment in each of the characters in the display, 128. The characters in the display 128 to be lighted are selected by a three binary bit column select signal COLSEL transmitted over line 76 (FIG. 3) from the processor 62 into the control logic block 72 (FIG. 3) for switching the transistor 36 (FIG. 3) of two characters into a conducting state, thereby resulting in the lighting of the selected characters. As shown in FIG. 4, the column select signal COLSEL (FIG. 4A) and the data signal (FIG. 4G) go high prior to the time the signal DBLANK goes low, the latter signal initiating a display-on interval.

Figure 6D:
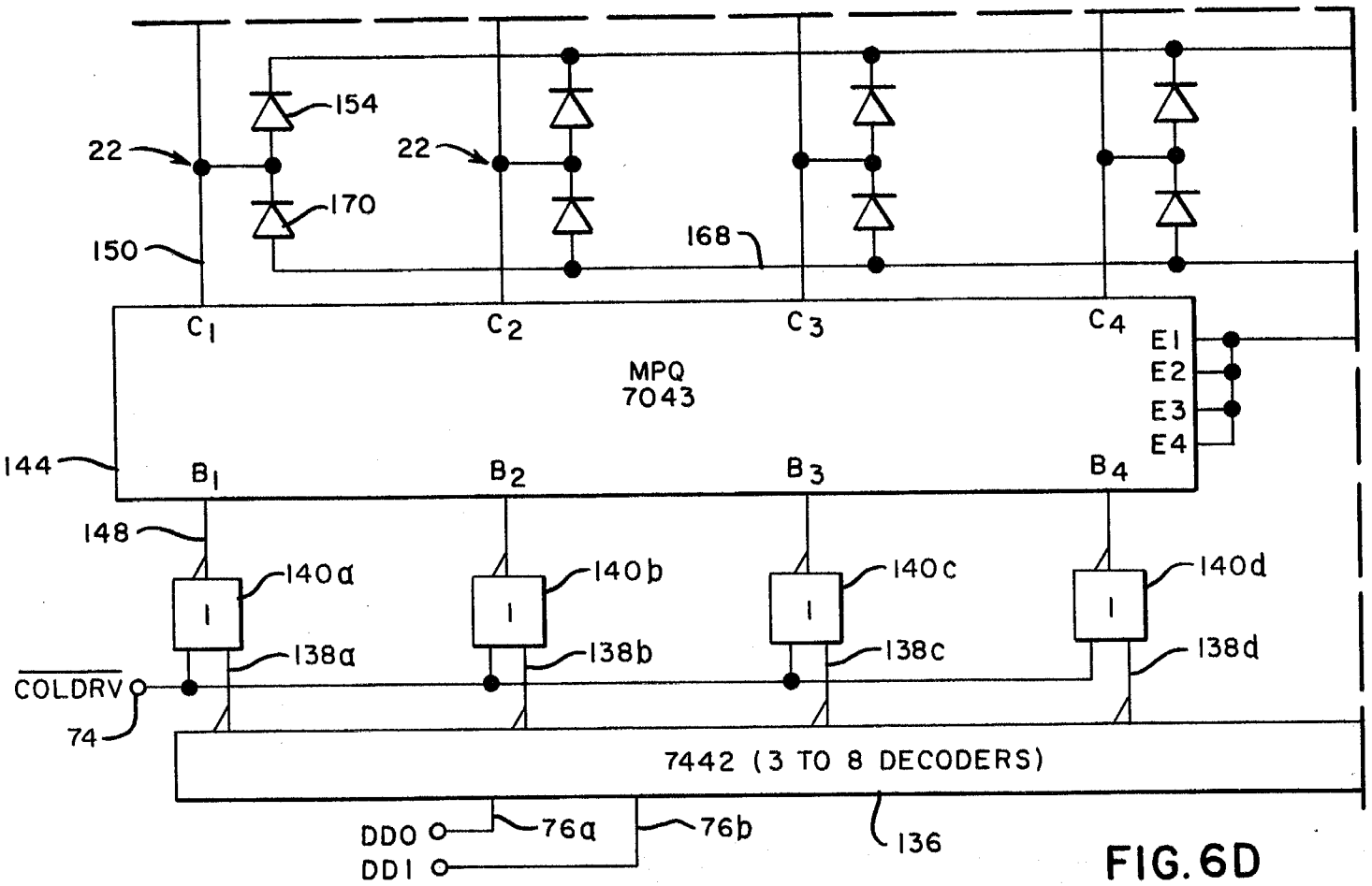
Figure 6E:
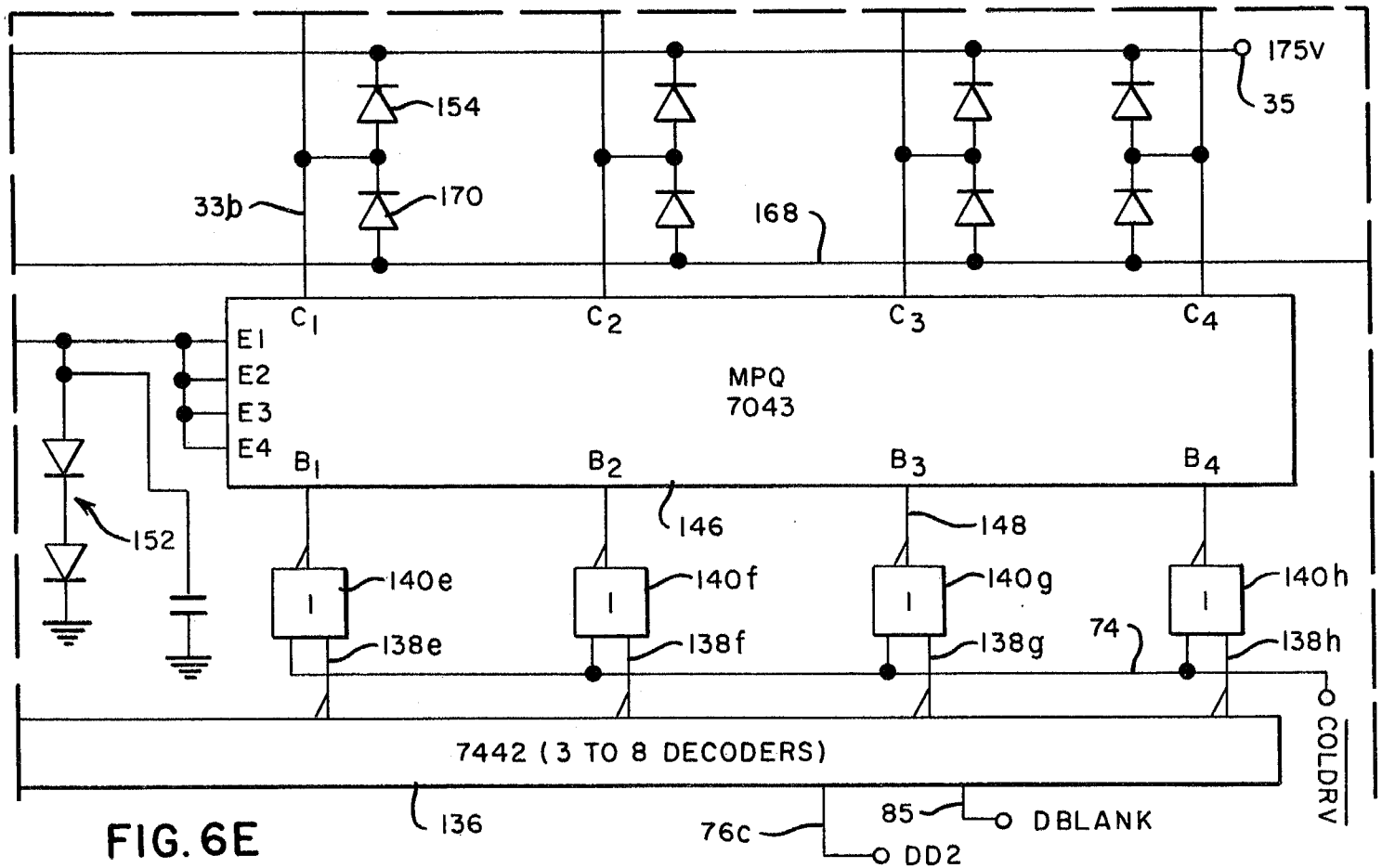

Referring now to FIGS. 6D and 6E, there is shown the control logic block (FIG. 3) which includes a 7442 three-to-eight decoder 136 receiving over its input lines 76A–C inclusive the 3 binary bits DD0–DD2 inclusive of the column select signal transmitted from the processor 62 and which represents the character to be displayed. Upon receiving the three binary bits, the decoder 136 will output over its output lines 138*a–*138*h* inclusive a control signal to one input of a plurality of NOR gates 140*a–*140*h* inclusive on whose other input appears the column drive signal $\overline{\text{COLDRV}}$ generated by the display signal generator 58 (FIG. 5) in a manner described previously and transmitted over line 74. The output lines 148 of the NOR gates 140*a–*140*h* inclusive are coupled to the input of a pair of MPQ 7043 quad transistor networks 144 (FIG. 6) and 146 (FIG. 6E). Each of the transistors located in the networks 144 and 146 correspond to the transistor 36 shown in FIG. 3. Each of the output lines 148 of the NOR gates 140*a–*140*h* inclusive is coupled to the base 70 (FIG. 3) of the transistor 36, while the collector 33*b* is coupled over line 150 to the electrode 22 of the cells 20 in a pair of characters in the display panel 128 (FIGS. 6A–6C inclusive), thereby resulting in the firing of the two characters in accordance with the cells or segments 28 (FIG. 2) that have been selected by the data bits stored in the shift registers 102–106 inclusive (FIGS. 6A–6C) in the manner described previously. As shown in FIGS. 6D and 6E, the emitters of transistors in the network 144 and 146 are tied to ground through a diode network 152 (FIG. 6E). In addition, the collectors 33*b* (FIG. 3) of the transistor 36 are isolated from the collectors of the other transistors in the pack by a diode network 170 (FIGS. 6D and 6E) while the diode network 154 clamps lines 150 to a maximum of 175 volts.

Figure 6F:
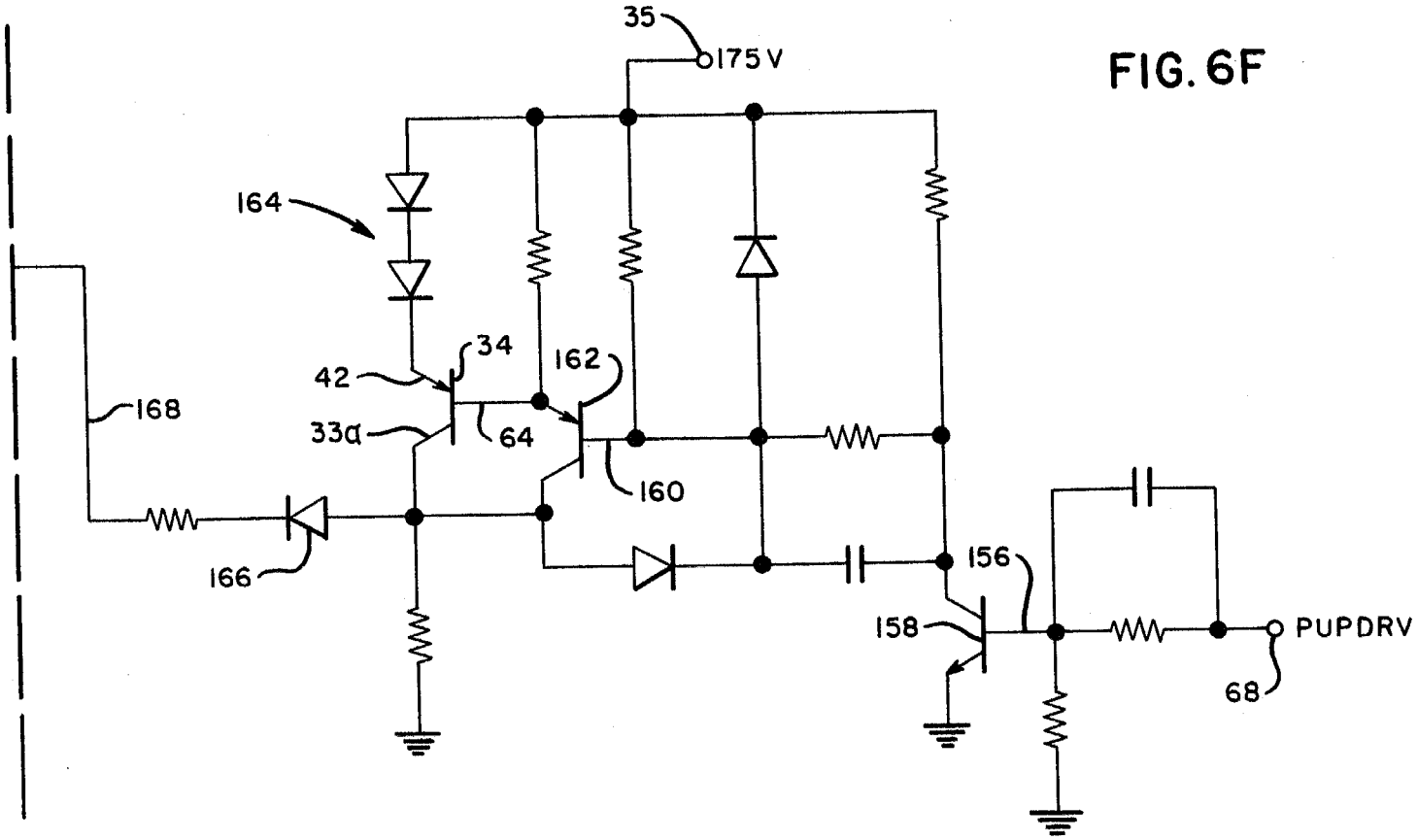

Referring now to FIG. 6F, there is shown the control logic block 66 (FIG. 3) which controls the operation of the transistor 34. As previously described, upon the signal DBLANK (FIG. 4C) going low, the display signal generator 58 (FIG. 3) will output over line 68 the pull-up driver signal PUPDRV (FIG. 4D) which is coupled to the base 156 of a transistor 158 which switches the transistor into a state of conduction thereby providing a current path to ground from the 175 volt power supply 35. When this occurs, the base 160 of a second transistor 162 is made more negative than the emitter, thereby switching the transistor 162 into a state of conduction which in turn switches the transistor 34 into a state of conduction. As described previously, upon the switching of the transistor 34, the 175 volt power supply 35 is transmitted through the diode network 164, the emitter 42, the collector 33*a*, the diode 166, line 168 and the diode network 170 (FIGS. 6B and 6C) to the electrode 22 (FIGS. 3 and 6B) of the display to fire the appropriate characters in the manner described previously upon the switching of the transistors 38–40 inclusive (FIG. 3) located in the 75426 IC 114–124 (FIGS. 6A–6C). In the present embodiment, the switching of the transistor 34 will impress the 175 volt power supply on the electrode 22 of each segment in the display panel 128 (FIGS. 6A–6C inclusive).

When the signal DBLANK (FIG. 4C) goes high at the end of the blanking interval, the 7442 three-to-eight decoder 136 (FIG. 6E) is disabled. In addition, the inverter 90 (FIG. 5) located in the display signal generator 58 will output a low signal to the flip-flops 86 and 88 thereby disabling the operation of the flip-flops resulting in the column drive signal COLDRV and the segment drive signal SEGDRV being held in a low state while the pull-up drive signal PUPDRV is held in a high state (FIG. 4) thereby holding the transistor 34 (FIG. 3) in a conducting state. Upon the drive signal COLDRV (FIG. 4F) going low, the NOR gates 140*a–*140*h* inclusive (FIGS. 6D and 6E) will output a low signal to the base 70 of the transistor 36 (FIG. 3) switching the transistor to a non-conducting state, thereby removing the ground path to the transistor 34.

When the segment driver signal SEGDRV (FIGS. 4A and 6C) goes low, the transistor 38 (FIG. 3) located in the 75426 IC 114–124 inclusive (FIGS. 6A–6C inclusive) will be switched to a non-conducting state, thereby disabling the 75 volt power supply 39 from being coupled to the cells in the display panel 128. The signal SEGDRV going low will also switch the transistor 40 (FIG. 3) to a conducting state, thereby providing a ground path to the 175 volt power supply 35 through the transistors 34 and 40, resulting in the charging of each of the cells in the display panel 128 to the 175 volt level, thereby insuring the firing of the cells in the display panel 128 during the next display-on interval. With respect to the logical elements utilized in this embodiment of the invention, it should be noted that they are well-known in the computer art and commercially available. The designated IC networks referred to in the application are available from Texas Instruments Inc. of Dallas, Tex. and Motorola Inc., of Phoenix, Ariz.

The present invention permits using relatively lower voltages for firing the cells in the display panel. The amount of voltage which supplies the gas-discharge display directly affects the display's consistency. Therefore, increasing the voltage to the display shortens the initialization time of a "display-on" interval and, thus, tends to override the display's original problem. Increasing the voltage, however, narrows the voltage operating range of the display panel which is unacceptable in low-cost gas-discharge displays in which the present invention is incorporated. In addition, the present invention eliminates the problem of the cell charge decay which occurs during a blank interval. By precharging each of the cells to the 175 volt level, this problem is eliminated.

While the invention has been described in its preferred embodiment, it is to be understood that the words which have been used are words of description rather than limitations and that changes may be made within the purview of the appended claims without departing from the true scope and spirit of the invention in its broader aspects.

What is claimed is:

1. A control circuit arrangement for a gas-discharge device of the type having a pair of insulated electrodes positioned within the device comprising in combination:

first means for applying a first predetermined potential source means across said electrodes of insufficient magnitude to effect discharge therebetween when enabled;

second means for applying a second predetermined potential source means across said electrodes of insufficient magnitude to effect discharge therebetween in the absence of said first potential source means across said electrodes and of sufficient magnitude to effect discharge therebetween during presence of said first potential source means when enabled;

first means for generating a first control signal during the time said discharge device is operational and no discharge is present between said electrodes and a second control signal when the device is to be discharged;

second means for generating a plurality of clock signals; and third means coupled to said first and second generating means for generating, in response to the generation of said first and second control signals and said clock signals, fourth, fifth and sixth control signals for enabling said first and second applying means whereby said first potential is applied across said electrode in response to the generation of said first control signal and said first and second potentials are cyclically applied across said electrodes in response to the generation of said second control signals and said clock signals.

2. The control circuit of claim 1 in which said first generating means comprises a processor for outputting said first control signal during the time the device is not to be discharged and said second control signal when the device is to be discharged.

3. The control circuit of claim 2 in which said first applying means includes first coupling means connected to a first potential source means and to said electrodes, and said third generating means includes a signal generator means coupled to said processor and operated in response to the generation of said first control pulse to output to said first coupling means said fourth and fifth control signals enabling said first coupling means to connect the first potential source means to said electrodes, thereby precharging the device.

4. The control circuit of claim 3 in which said second applying means includes second coupling means connected to a second potential source means and said electrode, said processor outputting said second control signal to said signal generator means whereby said signal generator means outputs said fifth and sixth control signals to said second coupling means enabling said second coupling means to connect the second potential source means to said precharge electrodes, thereby discharging said device.

5. A control circuit arrangement for use with a gas-discharge display device of the type having an array of cells in which each cell has a pair of electrodes comprising in combination:

first and second potential source means each being insufficient to discharge the electrodes in the cells;

first switching means adapted to couple said first potential source means to said electrodes when operated;

second switching means adapted to couple said second potential source means to said electrodes when operated;

first means for generating a first control signal, a second control signal disabling the discharging of the array of cells in the display device, a third control signal enabling the discharging of the cells and a plurality of fourth control signals selecting the cells to be discharged;

clock generating means coupled to said first generating means for generating a plurality of clock signals in response to the generation of said first control signal; and signal generating means coupled to said first generating means and said clock generating means for generating, in response to the generation of said clock signals and said second and third control signals, fourth, fifth and sixth control signals for operating said first and second switching means whereby said first potential source means is coupled to said electrodes in response to the generation of said second control signal and said first and second potential source means are cyclically coupled to said electrodes in response to the generation of said third control signal and said clock signals.

6. The control circuit of claim 5 in which said first generating means comprises a processor and said signal generator means is coupled to the output of said processor and operated in response to the generation of said second control signal to output said fourth and fifth control signals to said first and second switching means operating said first switching means whereby said first potential source means is applied to said electrodes in each cell precharging the cells.

7. The control circuit of claim 6 which further includes operating circuit means coupled to the output of said processor and said second switching means for disabling the operation of said second switching means during the time said processor is outputting said fourth control signal.

8. The control circuit of claim 7 in which said operating circuit means includes decoder means coupled to the output of said processor for outputting a seventh control signal conditioning a selected cell in the device for discharging.

9. The control circuit of claim 8 in which said operating circuit means further includes gating means coupled to the output of said decoder means and said signal generator means for enabling one of said second switching means upon receiving said third and sixth control signals whereby said second potential source means is applied to the electrodes in selected cells in the device, discharging the cells.

10. A multiple character gas-discharge device of the type having an array of cells in which each cell has a pair of electrodes and adapted for multiplex operation, comprising:

first and second potential source means each being insufficient to discharge the electrodes in the cells;

first switching means for applying said first potential source means across said electrodes when operated;

second switching means for applying said second potential source means across said electrodes when operated;

first means for generating a first control signal, a first blanking pulse disabling the discharging of the array of cells in the display device, a second blanking pulse enabling the discharging of the cells and a plurality of data control signals selecting the cells to be discharged;

clock generating means coupled to said first generating means for generating a plurality of clock signals in response to the generation of said first control signal; and signal generating means coupled to said first generating means and said clock generating means for generation, in response to the generation of said first and second blanking pulses, second, third and fourth control signals for operating said first and second switching means whereby said first potential source means is coupled to said electrodes in response to the generation of said first blanking pulse and said first and second potential source means are cyclically coupled to said electrodes in response to the generation of said second blanking pulse and said clock signals.

11. The device of claim 10 in which said first generating means comprises a processor, said processor generates, during the time said first blanking pulse is generated, said plurality of data control signals specifying the cells to be discharged, and said signal generating means includes control means coupled to said processor and said second switching means for receiving said data control signals said control means operating said second switching means to apply said second potential source means to the electrodes in the cells specified by the address pulses.

12. The device of claim 11 in which said first and second switching means comprises pairs of transistors, one of which is coupled to the potential source means with the other one connected to ground.

13. The device of claim 12 which further includes operating circuit means coupled to the output of said processor and said second switching means for disabling the operation of said second switching means during the time said processor is outputting said first blanking pulse.

14. The control device of claim 13 in which said operating circuit means includes decoder means coupled to the output of said processor for outputting a fifth control signal conditioning a selected cell in the device for discharging.

* * * * *